US008191175B1

(12) United States Patent
White

(10) Patent No.: US 8,191,175 B1
(45) Date of Patent: Jun. 5, 2012

(54) CAP VISOR PROTECTOR

(76) Inventor: Steven L. White, Lansing, MI (US)

( * ) Notice: Subject to any disclaimer, the term of this patent is extended or adjusted under 35 U.S.C. 154(b) by 494 days.

(21) Appl. No.: 12/505,186

(22) Filed: Jul. 17, 2009

(51) Int. Cl.
*A42B 1/00* (2006.01)

(52) U.S. Cl. ..... 2/175.5; 2/175.1; 2/175.4; 2/209.13; 2/175.3; 2/195.1

(58) Field of Classification Search ..... 2/46, 195.1, 2/209.12, 209.13, 209.14, 175.1, 175.5, 171, 2/12, 10, 175.4
See application file for complete search history.

(56) References Cited

U.S. PATENT DOCUMENTS

| | | | | |
|---|---|---|---|---|
| 1,106,527 | A | 8/1914 | Velardo | |
| 1,337,506 | A | 4/1920 | Chew | |
| 1,453,862 | A | 5/1923 | Check | |
| 1,615,780 | A | 1/1927 | Wesala | |
| 2,137,050 | A | 11/1938 | Iannetta | |
| 3,166,766 | A | 1/1965 | Banello, Jr. | |
| 3,469,264 | A | 9/1969 | Harris | |
| 4,345,336 | A | 8/1982 | Plastino | |
| 5,003,639 | A | 4/1991 | White | |
| 5,410,761 | A * | 5/1995 | Connelly et al. | 2/195.1 |
| 5,659,896 | A * | 8/1997 | Taylor | 2/12 |
| 5,778,454 | A * | 7/1998 | Oxman | 2/195.1 |
| 5,956,773 | A * | 9/1999 | LaMantia | 2/195.1 |
| 5,991,927 | A * | 11/1999 | Barbaccia | 2/209.13 |
| 6,044,495 | A * | 4/2000 | Ellman et al. | 2/195.1 |
| 7,178,173 | B2 * | 2/2007 | Kronenberger | 2/209.13 |
| 7,472,429 | B1 | 1/2009 | Lawrence | |
| 1,745,114 | A1 | 7/2009 | Oishei et al. | |
| 7,591,026 | B2 * | 9/2009 | Kronenberger | 2/209.13 |
| 2005/0172380 | A1 * | 8/2005 | Turkington | 2/175.4 |

* cited by examiner

*Primary Examiner* — Alissa Tompkins
(74) *Attorney, Agent, or Firm* — Young Basile Hanlon & MacFarlane P.C.

(57) ABSTRACT

A visor protector for caps having a visor including a periphery having a front edge, a pair of lateral edges, and upper and lower sides. The visor protector includes a flexible body having an upper portion and a lower portion. The upper portion of the flexible body meets the lower portion of the flexible body at a leading edge of the flexible body. The upper portion of the flexible body is receivable on the upper side of the visor, and the lower portion of the flexible body is receivable on the lower side of the visor. The upper and lower portions of the flexible body cooperate to define a substantial U-shape, wherein the visor is receivable between the upper and lower portions such that the leading edge of the flexible body is substantially aligned with the front edge of the visor. The visor protector includes a pair of spring clips that each have a first leg that is engageable with the upper portion of the flexible body and a second leg that is engageable with the lower portion of the flexible body. The spring clips are configured to urge the flexible body into engagement with the visor. Indicia, such as advertising, can be placed on the visor protector to provide the perfect promotional platform for products.

8 Claims, 1 Drawing Sheet

CAP VISOR PROTECTOR

FIELD OF THE INVENTION

The present invention relates to the field of accessories for caps having visors, and more particularly, the invention relates to an improved cap visor protector.

BACKGROUND OF THE INVENTION

Lightweight caps are very popular for casual wear, and such caps usually include adjustable headbands, a crown, and a prominent visor. Advertising or other indicia is often imprinted, embossed, or otherwise applied to the front of the crown of the cap, above the visor. As such caps are frequently worn while working, engaging in sports or other physical activity, or in other situations where the wearer's hands may become dirty, grasping the visor to remove or adjust the cap results in the visor rapidly becoming soiled and unattractive.

Previously, devices for protecting cap visors have been proposed. According to one known cap protector design, a flexible element is positioned over the front edge of the visor of the cap, and held in place using elastic cords that are anchored to the side edges of the visor. While such protectors are effective, a tight, smooth fit of the protector with respect to the visor of the cap may be difficult to achieve. For instance, when the visor of the cap is bent in a traditional "U-shape" form, the flexible element on the underside of the visor will often sag, thereby obstructing the wearer's vision.

According to another known cap protector design, a substantially rigid, u-shaped metal body is placed over the front edge of the visor of the cap to maintain the shape of the visor. While this device device also performs its intended purpose, it is relatively heavy, and cannot be easily adapted to cap visors having varied or unusual curvatures.

In light of the foregoing, it would be desirable to have a cap visor protector that is simple in construction, maintains a firm attachment to the visor of the cap, is lightweight in construction, and may be cleaned easily. It would also be desirable to have a cap visor protector that may be readily applied to existing visored caps without requiring unusual skills. In addition, it would be desirable to have a cap visor protector that adds to the aesthetic appearance of the cap and visor, as the cap visor protector may be formed of leather, felt, or a wide variety of materials of any color. It would also be desirable to have a cap visor protector that may be economically manufactured, is capable of having indicia or advertising located thereon, and is readily adjustable and usable with a wide variety of visor shapes, dimensions, and configurations.

SUMMARY OF THE INVENTION

The present invention relates to a visor protector for caps having a visor including a periphery having a front edge, a pair of lateral edges, and upper and lower sides. The visor protector includes a flexible body having an upper portion and a lower portion. The upper portion of the flexible body meets the lower portion of the flexible body at a leading edge of the flexible body. The upper portion of the flexible body is receivable on the upper side of the visor, and the lower portion of the flexible body is receivable on the lower side of the visor. The upper and lower portions of the flexible body cooperate to define a substantial U-shape, wherein the visor is receivable between the upper and lower portions such that the leading edge of the flexible body is substantially aligned with the front edge of the visor. The visor protector includes a pair of spring clips that each have a first leg that is engageable with the upper portion of the flexible body and a second leg that is engageable with the lower portion lower portion of the flexible body. The spring clips are configured to urge the flexible body into engagement with the visor.

The upper and lower portions of the flexible body may each have a pair of lateral edges, wherein each spring clip of the pair of spring clips is positioned adjacent to a respective lateral edge of the pair of lateral edges of the upper and lower portions of the flexible body. Furthermore, the visor protector may include a pair of elongate pockets that are each formed on the upper portion of the flexible body, such that each of the elongate pockets is adjacent to a respective lateral edge of the upper portion of the flexible body. The elongate pockets have open ends adjacent to the leading edge of the flexible body and closed ends adjacent to a trailing edge of the upper portion of the flexible body, wherein the first legs of the pair of spring clips are each receivable in a respective elongate pocket of the pair of elongate pockets. The visor protector may further include a pair of pockets that are formed on the lower portion of the flexible body, such that each pocket is adjacent to a respective lateral edge of the lower portion. The second legs of the pair of spring clips are each receivable in a respective pocket of the pair of pockets.

Each spring clip of the pair of spring clips may have a widened portion at a junction between the first leg and the second leg. Furthermore, the widened portion of each spring clip of the pair of spring clips may include a tab that extends substantially perpendicular to the first and second legs of the spring clip.

The second leg of each spring clip of the pair of spring clips may be shorter than the first leg of each spring clip of the pair of spring clips in order to facilitate installation and removal of the spring clips with respect to the flexible body. Additionally, the lower portion of the flexible body may be shorter than the upper portion of the flexible body, such that an end of the lower leg of each spring clip spring clip is positionable adjacent to a terminal edge of the lower portion, and an end of the upper leg of each spring clip is positionable adjacent to a terminal edge of the upper portion.

The lower portion of the flexible body may be bifurcated laterally. The upper portion of the flexible body may be fabricated from a non-stretchable fabric, and the lower portion of the flexible body may be fabricated from a stretchable fabric.

BRIEF DESCRIPTION OF THE DRAWINGS

The description herein makes reference to the accompanying drawings wherein like referenced numerals refer to like parts throughout several views and wherein.

DETAILED DESCRIPTION OF THE PREFERRED EMBODIMENT

Figure 1:
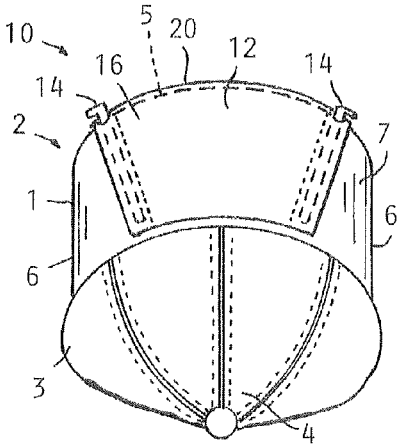
FIG. 1 is a top view of a cap having an improved cap visor protector mounted thereon according to the present invention.

Referring to the drawings, the present invention will now be described in detail with reference to the disclosed embodiment.

Figure 2:
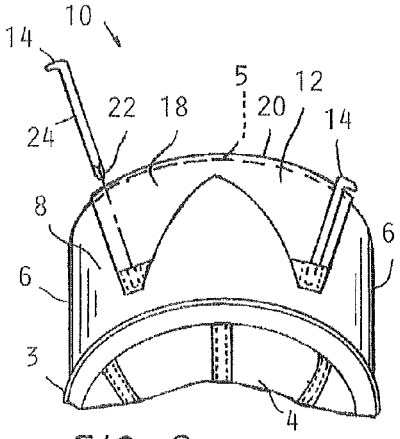
FIG. 2 is a bottom view of the cap having the improved cap visor protector mounted thereon according to the present invention.

FIGS. 1-2 show a visor protector 10 according to the present invention disposed upon a visor 1 of a cap 2. The cap 2 may be a typical baseball-style cap having a headband 3 and a crown portion 4, wherein the visor 1 extends outwardly from the headband 3 of the cap 2. The visor 1 has a front edge 5, a pair of lateral edges 6, an upper side 7, and a lower side 8. While the visor protector 10 will be described herein with reference to the cap 1, it should be understood that the visor protector 10 may be used in conjunction with any cap or hat having a visor 1 and is not limited to use with the cap 2 shown and described herein.

In order for the visor protector 10 of the present invention to fit neatly and securely on the visor 1 of the cap 2, the visor protector 10 includes a flexible body 12 and a pair of spring clips 14. In particular, the flexible body 12 has an upper portion 16 and a lower portion 18. The upper portion 16 of the flexible body 12 is receivable on the upper side 7 of the visor 1, while the lower portion 18 of the flexible body 12 is receivable on the lower side 8 of the visor 1. The upper and lower portions 16, 18 of the flexible body 12 meet at a leading edge 20 of the flexible body 12, which is substantially aligned with the front edge 5 of the visor 1 when the flexible body 12 is disposed upon the visor 1. When disposed upon the visor 1, the upper and lower portions 16, 18 of the flexible body 12 cooperate to define a substantial U-shape, with the visor 1 disposed within the substantially U-shaped flexible body 12.

In order to retain the flexible body 12 upon the visor 1, the pair of spring clips 14 are configured to urge the flexible body 12 into engagement with the visor 1. The spring clips 14 each have a first leg 22 that is engageable with the upper portion 16 of the flexible body 12 and a second leg 24 that is engageable with the lower portion 18 of the flexible body 12, such that the visor 1 and the flexible body 12 are receivable between the first and second legs 22, 24 of each of the spring clips 14. 14.

Figure 3:
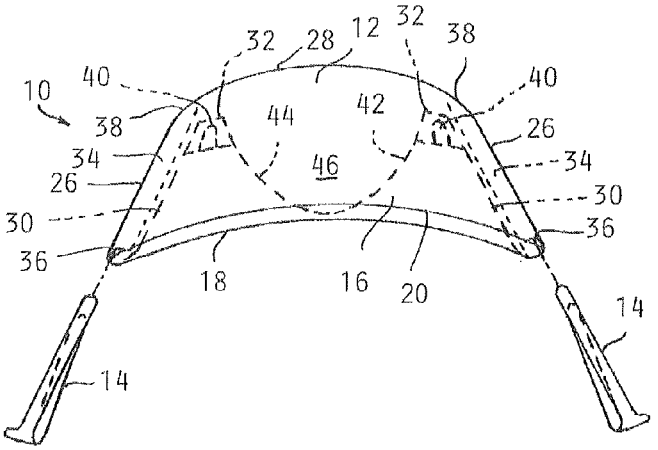
FIG. 3 is an exploded view showing the improved cap visor protector according to the present invention.
Figure 4:
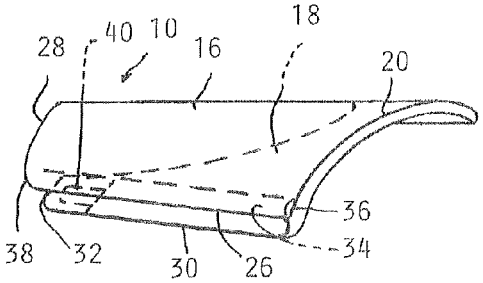
FIG. 4 is a side view of the improved cap visor protector according to the present invention.

As best seen in FIG. 3, the upper portion 16 of the flexible body 12 includes a pair of lateral edges 26 that are opposite one another and a trailing edge 28 that is opposite the leading edge 20 of the flexible body 12. Similarly, the lower portion 18 of the flexible body 12 has a pair of lateral edges 30 and a trailing edge 32.

To firmly secure the flexible body 12 with respect to the visor 1, each of the spring clips 14 is positioned adjacent to a respective pair of the lateral edges 26, 30 of the upper and lower portions 16, 18 of the flexible body 12. In particular, a pair of elongate pockets 34 may be provided on the upper portion 16 of the flexible body 12 at the lateral edges 26 thereof, wherein the first legs 22 of the spring clips 14 are receivable within the elongate pockets 34. The elongate pockets 34 each have an open end 36 adjacent to the leading edge 20 of the flexible body 12 and a closed end 38 adjacent to the trailing edge 28 of the upper portion 16. Similarly, a pair of pockets 40 are formed on the lower portion 18 of the flexible member 12, each pocket 40 being adjacent to a respective lateral edge 30 of the lower portion 18. The second legs 24 of the spring clips 14 are each receivable in one of the pockets 40.

In order to accommodate the spring clips 14, as will be explained further, the lower portion 18 of the flexible body 12 is shorter than the upper portion 16 of the flexible body 12, as measured from the leading edge 20 to the respective trailing edges 28, 32 of the upper and lower portions 16, 18 of the flexible body 12. In order to provide a snug, contoured fit for the lower portion 18 of the flexible body 12, the lower portion 18 can be bifurcated into a pair of lateral portions 42, 44 that are separated by a substantially V-shaped cutout 46. Because the lower side 8 of the visor 1 may have a substantially concave profile, bifurcation of the lower portion 18 of the flexible body 12 into the lateral portions 42, lateral portions 42, 44 avoids having a large expanse of the lower portion 18 that is spaced from the lower side 8 of the visor 1.

The flexible body 12 may be fabricated from many suitable materials, such as felt, canvas, or a wide variety of materials of any color. In particular, the upper portion 16 of the flexible body 12 is typically fabricated from a non-stretchable material, such as canvas, felt, or leather, while the lower portion 18 of the flexible body 12 is fabricated from a stretchable fabric, which allows, for some degree, a variation of the shape of the lower portion 18 of the flexible body 12 in order to accommodate visors 1 of various geometries. Also, indicia, such as advertising or athletic team logos, may be provided on the flexible body 12, preferably on the upper portion 16, thereof. Accordingly, the visor protector 10 may function as a perfect promotional platform for products.

Figure 5:
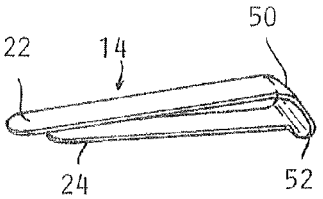
FIG. 5 is a perspective view showing a spring clip of the improved cap visor protector according to the present invention.

As best seen in FIG. 5, the first leg 22 and the second leg 24 of each of the spring clips 14 meet one another at a junction 50. The second leg 24 of each of the spring clips 14 is shorter than the first leg 22 thereof in order to facilitate installation and removal of the spring clips 14 with respect to the flexible body 12. In particular, by making the first leg 22 of the spring clip 14 longer, the first leg 22 is adapted to engage the flexible body 12 in advance of engagement of the second leg 24 with the flexible body 12, which allows the user of the visor protector 10 to easily spread the second leg 24 of the spring clip 14 apart from the first leg 22 of the spring clip 14 so that the visor 1 and the flexible body 12 may be received in between the first and second legs 22, 24 of the spring clip 14.

In order to allow easy manipulation of the spring clips 14, each spring clip 14 has a widened portion in the form of a tab 52 that is adapted to be grasped by the user. The tab 52 of each spring clip 14 extends substantially perpendicular to the first and second legs 22, 24 of the spring clip 14. The tab 52 is located at the junction 50 of each spring clip 14.

In use, a user first places the upper portion 16 of the flexible body 12 onto the upper side 7 of the visor 1 and places the lower portion 18 of the flexible body 12 onto the lower side 8 of the visor 1 to define a substantial U-shape for the flexible body 12. The user then grasps one of the spring clips 14, such as by grasping the tab 52 thereof, and moves the first leg 22 of the spring clip 14 into engagement with the open end 36 of one of the elongate pockets 34 in the upper portion 16 of the flexible body 12. The user then manipulates the spring clip 14 to move the second leg 24 away from the first leg 22 so that the second leg 24 may be engaged with the lower portion 18 of the flexible body 12, moved inwardly onto the visor 1, and then placed within one of the pockets 40 on the lower portion 18 of the flexible body 12. This process is repeated for the other spring clip 14.

The visor protector 10 may be subsequently removed, such as for washing, by grasping the spring clips 14 using the pull tabs 52 and removing the spring clips 14 from the flexible body 12. Once the spring clips 14 are removed from the flexible body 12, the flexible body 12 may be removed from the visor 1.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A visor protector for caps having a visor having a front edge, a pair of lateral edges, and upper and lower sides, the visor protector comprising:

a flexible body having an upper portion and a lower portion, the upper portion meeting the lower portion at a leading edge of the flexible body;

the upper portion of the flexible body receivable on the upper side of the visor;

the lower portion of the flexible body receivable on the lower side of the visor so that the upper portion and the lower portion cooperate to define a substantial u-shape, wherein the visor is receivable between the upper portion and the lower portion such that the leading edge of the flexible body is substantially aligned with the front edge of the visor;

a pair of spring clips each having a first leg engageable with the upper portion of the flexible body and a second leg engageable with the lower portion of the flexible body such that the spring clips are configured to urge the flexible body into engagement with the visor;

a pair of elongate pockets each formed on the upper portion of the flexible body each adjacent to a respective lateral edge of the upper portion of the flexible body, the elongate pockets each having an open end adjacent to the leading edge of the flexible body and a closed end adjacent to a trailing edge of the upper portion of the flexible body, wherein the first legs of the pair of spring clips are each receivable in a respective elongate pocket of the pair of elongate pockets; and a pair of pockets formed on the lower portion of the flexible body, each adjacent to a respective lateral edge of the lower portion, wherein the second legs of the pair of spring clips are each receivable in a respective pocket of the pair of pockets.

2. The visor protector of claim 1, further comprising:

each spring clip of the pair of spring clips having a widened portion at a junction between the first leg and the second leg; and the widened portion of each spring clip of the pair of spring clips including a tab that extends substantially perpendicular to the first and second legs thereof.

3. The visor protector of claim 1, further comprising:

wherein the second leg of each spring clip of the pair of spring clips is shorter than the first leg of each spring clip of the pair of spring clips to facilitate installation and removal of the spring clips with respect to the flexible body.

4. The visor protector of claim 3, wherein the lower portion of the flexible body is shorter than the upper portion of the flexible body, such that an end of the lower leg of each spring clip is positionable adjacent to a terminal edge of the lower portion and an end of the upper leg of each spring clip is positionable adjacent to a terminal edge of the upper portion.

5. The visor protector of claim 1, further comprising:

wherein the upper portion of the flexible body is fabricated from a non-stretchable fabric, and the lower portion of the flexible body is fabricated from a stretchable fabric.

6. A visor protector for caps having a visor having a front edge, a pair of lateral edges, and upper and lower sides, the visor protector comprising:

a flexible body having an upper portion and a lower portion, the upper portion meeting the lower portion at a leading edge of the flexible body;

the upper portion of the flexible body receivable on the upper side of the visor;

the lower portion of the flexible body receivable on the lower side of the visor so that the upper portion and the lower portion cooperate to define a substantial u-shape, wherein the visor is receivable between the upper portion and the lower portion such that the leading edge of the flexible body is substantially aligned with the front edge of the visor;

a pair of spring clips each having a first leg engageable with the upper portion of the flexible body and a second leg engageable with the lower portion of the flexible body such that the spring clips are configured to urge the flexible body into engagement with the visor, wherein the second leg of each spring clip of the pair of spring clips is shorter than the first leg of each spring clip of the pair of spring clips to facilitate installation and removal of the spring clips with respect to the flexible body, and each spring clip of the pair of spring clips having a widened portion at a junction between the first leg and the second leg, the widened portion of portion of each spring clip of the pair of spring clips including a tab that extends substantially perpendicular to the first and second legs thereof;

a pair of elongate pockets each formed on the upper portion of the flexible body, each adjacent to a respective lateral edge of the upper portion of the flexible body, the elongate pockets each having an open end adjacent to the leading edge of the flexible body and a closed end adjacent to a trailing edge of the upper portion of the flexible body, wherein the first legs of the pair of spring clips are each receivable in a respective elongate pocket of the pair of elongate pockets; and a pair of pockets formed on the lower portion of the flexible body, each adjacent to a respective lateral edge of the lower portion, wherein the second legs of the pair of spring clips are each receivable in a respective pocket of the pair of pockets.

7. The visor protector of claim 6, wherein the lower portion of the flexible body is shorter than the upper portion of the flexible body, such that an end of the lower leg of each spring clip is positionable adjacent to a terminal edge of the lower portion and an end of the upper leg of each spring clip is positionable adjacent to a terminal edge of the upper portion.

8. The visor protector of claim 7, further comprising:

wherein the upper portion of the flexible body is fabricated from a non-stretchable fabric, and the lower portion of the flexible body is fabricated from a stretchable fabric.

* * * * *